US008444474B2

(12) United States Patent
Jaffe et al.

(10) Patent No.: US 8,444,474 B2
(45) Date of Patent: May 21, 2013

(54) WAGERING GAME WITH ACCUMULATION-BONUS FEATURE THAT IS PLAYED UPON PLAYER'S SELECTION

(75) Inventors: Joel R. Jaffe, Chicago, IL (US); Michael W. Mastropietro, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 221 days.

(21) Appl. No.: 12/940,199

(22) Filed: Nov. 5, 2010

(65) Prior Publication Data

US 2011/0118000 A1 May 19, 2011

Related U.S. Application Data

(60) Provisional application No. 61/260,963, filed on Nov. 13, 2009.

(51) Int. Cl.
*A63F 9/24* (2006.01)

(52) U.S. Cl.
USPC ..... 463/20; 273/138.1; 463/16; 463/25

(58) Field of Classification Search
None
See application file for complete search history.

(56) References Cited

U.S. PATENT DOCUMENTS

| | | | | |
|---|---|---|---|---|
| 5,377,973 | A | 1/1995 | Jones et al. | |
| 5,788,573 | A | 8/1998 | Baerlocher et al. | |
| 5,816,918 | A | 10/1998 | Kelly et al. | |
| 5,935,002 | A | 8/1999 | Falciglia | |
| 6,004,207 | A | 12/1999 | Wilson, Jr. et al. | |
| 6,068,552 | A | 5/2000 | Walker et al. | |
| 6,120,031 | A | 9/2000 | Adams | |
| 6,190,255 | B1 | 2/2001 | Thomas et al. | |
| 6,319,125 | B1 | 11/2001 | Acres | |
| 6,398,218 | B1 * | 6/2002 | Vancura | 273/138.1 |
| 6,609,975 | B1 | 8/2003 | Sawyer et al. | |
| 6,620,045 | B2 | 9/2003 | Berman et al. | |
| 6,726,563 | B1 | 4/2004 | Baerlocher et al. | |
| 6,739,971 | B2 | 5/2004 | Devaull | |
| 7,070,501 | B2 | 7/2006 | Cormack et al. | |
| 7,300,351 | B2 | 11/2007 | Thomas | |
| 7,559,837 | B1 * | 7/2009 | Yoseloff et al. | 463/21 |
| 7,654,897 | B2 | 2/2010 | Devaull et al. | |
| 7,775,872 | B2 | 8/2010 | Bleich et al. | |
| 2002/0151346 | A1 * | 10/2002 | Devaull | 463/20 |
| 2003/0157978 | A1 | 8/2003 | Englman | |
| 2004/0166918 | A1 * | 8/2004 | Walker et al. | 463/16 |
| 2006/0116194 | A1 * | 6/2006 | Pacey et al. | 463/20 |
| 2006/0128456 | A1 * | 6/2006 | Berman et al. | 463/13 |
| 2007/0167223 | A1 * | 7/2007 | Bleich et al. | 463/25 |

(Continued)

FOREIGN PATENT DOCUMENTS

| | | | |
|---|---|---|---|
| EP | 0827402 | A2 | 7/1988 |
| GB | 2222712 | A | 3/1990 |

OTHER PUBLICATIONS

Atronic Group Article: New Era; by GGB Staff; Global Gaming Business; dated Nov. 2008; (5 pages).

(Continued)

*Primary Examiner* — Paul A D'Agostino
(74) *Attorney, Agent, or Firm* — Nixon Peabody LLP

(57) ABSTRACT

A gaming system for conducting a wagering game includes an accumulation-bonus feature which allows a player to cache awards to a bonus object. A player selects when to use the bonus object in a secondary playfield to enhance the cached awards.

25 Claims, 9 Drawing Sheets

U.S. PATENT DOCUMENTS

| | | | | |
|---|---|---|---|---|
| 2008/0300051 | A1* | 12/2008 | Walker et al. | 463/25 |
| 2009/0117993 | A1* | 5/2009 | Bigelow et al. | 463/22 |
| 2009/0124327 | A1* | 5/2009 | Caputo et al. | 463/20 |
| 2009/0124337 | A1* | 5/2009 | Lyons et al. | 463/20 |
| 2009/0124346 | A1* | 5/2009 | Baerlocher | 463/20 |
| 2009/0124364 | A1* | 5/2009 | Cuddy et al. | 463/27 |
| 2009/0124373 | A1* | 5/2009 | Acres | 463/29 |
| 2009/0176551 | A1* | 7/2009 | Wilson | 463/20 |
| 2009/0181759 | A1* | 7/2009 | Baumgartner et al. | 463/25 |
| 2010/0075745 | A1* | 3/2010 | Gomez et al. | 463/25 |
| 2010/0113120 | A1* | 5/2010 | Snow | 463/16 |
| 2010/0120495 | A1* | 5/2010 | Frank et al. | 463/20 |
| 2010/0120521 | A1* | 5/2010 | Caputo et al. | 463/26 |
| 2010/0120525 | A1* | 5/2010 | Baerlocher et al. | 463/29 |
| 2010/0160028 | A1* | 6/2010 | Robichaud | 463/20 |
| 2010/0190542 | A1* | 7/2010 | Mizue | 463/20 |
| 2011/0028202 | A1* | 2/2011 | Naicker et al. | 463/20 |
| 2011/0039610 | A1* | 2/2011 | Baerlocher et al. | 463/12 |
| 2011/0086695 | A1* | 4/2011 | Evans | 463/20 |

OTHER PUBLICATIONS

Atronic Americas Article; Tree of Riches, dated Nov. 2008; (1 page).

Tree of Riches Article; dated Nov. 2008; (2 pages).

Product Sheet for MONOPOLY® Chairman of the Board™ (Reel), WMS Gaming Inc., 2 pages (1999).

Product Sheet for BOOM™ Video, WMS Gaming Inc., 1 page (1998).

Product Sheet for XFACTOR™ Plus, WMS Gaming Inc., 2 pages (1997).

Brochure for MULTI-PAY™, WMS Gaming Inc., 4 pages (1997).

Reproduction of Game Glass for Shopping Spree, WMS Gaming Inc., 1 page (available before 2000).

Product Sheet for Monopoly® Chairman of the Board™ (Video), WMS Gaming Inc., 1 page (published before 1999).

* cited by examiner

WAGERING GAME WITH ACCUMULATION-BONUS FEATURE THAT IS PLAYED UPON PLAYER'S SELECTION

CROSS-REFERENCE TO RELATED APPLICATION

This application claims the benefit of U.S. Provisional Patent Application No. 61/260,963, filed Nov. 13, 2009, entitled "Wagering Game with Accumulation-Bonus Feature that is Played Upon Player's Selection" which is hereby incorporated by reference in it's entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to a gaming apparatus, and methods for playing wagering games, and more particularly, to a wagering game having a bonus-accumulating feature.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. One way of increasing the attractiveness of such games to players is to provide a bonus game or event. Typical bonus games provide extra incentives for players to continue playing at gaming terminals. The availability of new bonus game features is particularly attractive to entice players by providing new forms of entertainment and increasing the likelihood of winning.

SUMMARY OF THE INVENTION

According to one aspect of the present concepts, a gaming system includes a user interface device to accept a wager input to play a wagering game and a display adapted for displaying a randomly determined outcome of the wagering game from a plurality of outcomes. The gaming system further includes a controller operative to randomly determine a winning outcome from the plurality of outcomes, where the winning outcome is associated with a value. The controller is also operative to randomly determine whether to cache the value to a bonus object, and, responsive to at least one random determination to cache the value, provide a player with an option to utilize the bonus object. The controller is further operative to, in response to a player input, randomly determine an enhancement condition for the bonus object and apply the enhancement condition to at least the value cached to the bonus object.

According to another aspect of the present concepts, a gaming device includes a wager input device for receiving a wager to play a wagering game and one or more processors for randomly determining an outcome of the wagering game from a plurality of outcomes. At least one of the outcomes is a winning outcome associated with a value and any of the one or more processors randomly determines whether to cache the value to a bonus object. The gaming device also includes a player input device for utilizing the bonus object. Further, any of the one or more processors continues to randomly determine whether to cache values to the bonus object until a player input is received from the player input device to utilize the bonus object. The player input causes any of the one or more processors to randomly determine an enhancement condition for the bonus object and the enhancement condition is applied to the entirety of the values cached to the bonus object.

According to yet another aspect of the present concepts, a method of conducting a wagering game for a human player is conducted wherein the wagering game includes a game sequence in which the player provides a wager input and a wagering game outcome is determined. The method includes the acts of using a user interface device to accept the wager input and transforming the wager input to electronic data signals indicative of a wager to play the wagering game. The method also includes using one or more processors to interpret the wager from the data signals and to cause the recording of a digital representation of the wager in one or more storage devices. The method further includes using at least one of the one or more processors to initiate the game sequence of the wagering game and to randomly determine the wagering game outcome. In response to the randomly determined outcome being a winning outcome associated with a value, the method includes using at least one of the one or more processors to randomly determine whether to cache the value to a bonus object. The method further includes, responsive to at least one random determination to cache the value, providing the player with an option to utilize the bonus object and continuing to use at least one of the one or more processors to randomly determine wagering game outcomes associated with corresponding values and to randomly determine whether to cache the corresponding values associated with the randomly determined winning game outcomes to the bonus object until a player input is received to utilize the bonus object. The method also includes, in response to the player input, using at least one of the one or more processors to randomly determine an enhancement condition for the bonus object and applying the enhancement condition to all of the values cached to the bonus object.

According to yet another aspect of the present concepts, a method of conducting a wagering game on a gaming system includes using one or more processors to randomly determine an outcome of the wagering game. The randomly determined outcome is associated with a value. In response to the randomly determined outcome satisfying a predetermined condition, the method also includes any of the one or more processors causing the value of the randomly determined outcome to be cached to a bonus object and providing the player with an option to utilize the bonus object. The method further includes continuing to use any of the one or more processors to randomly determine outcomes associated with corresponding values and to cache the corresponding values in response to the randomly determined outcomes satisfying the predetermined condition until a player input is received to utilize the bonus object. Further, the method includes, in response to the player input, using any of the one or more processors to randomly determine an enhancement condition for the bonus object. The enhancement condition is applied to the entirety of the values cached to the bonus object and selected from among a plurality of enhancement conditions.

According to yet another aspect of the present concepts, a computer program product comprises a computer readable medium having an instruction set for directing a gaming system to perform the above methods.

Additional aspects of the invention will be apparent to those of ordinary skill in the art in view of the detailed description of various embodiments, which is made with reference to the drawings, a brief description of which is provided below.

Figure 1:
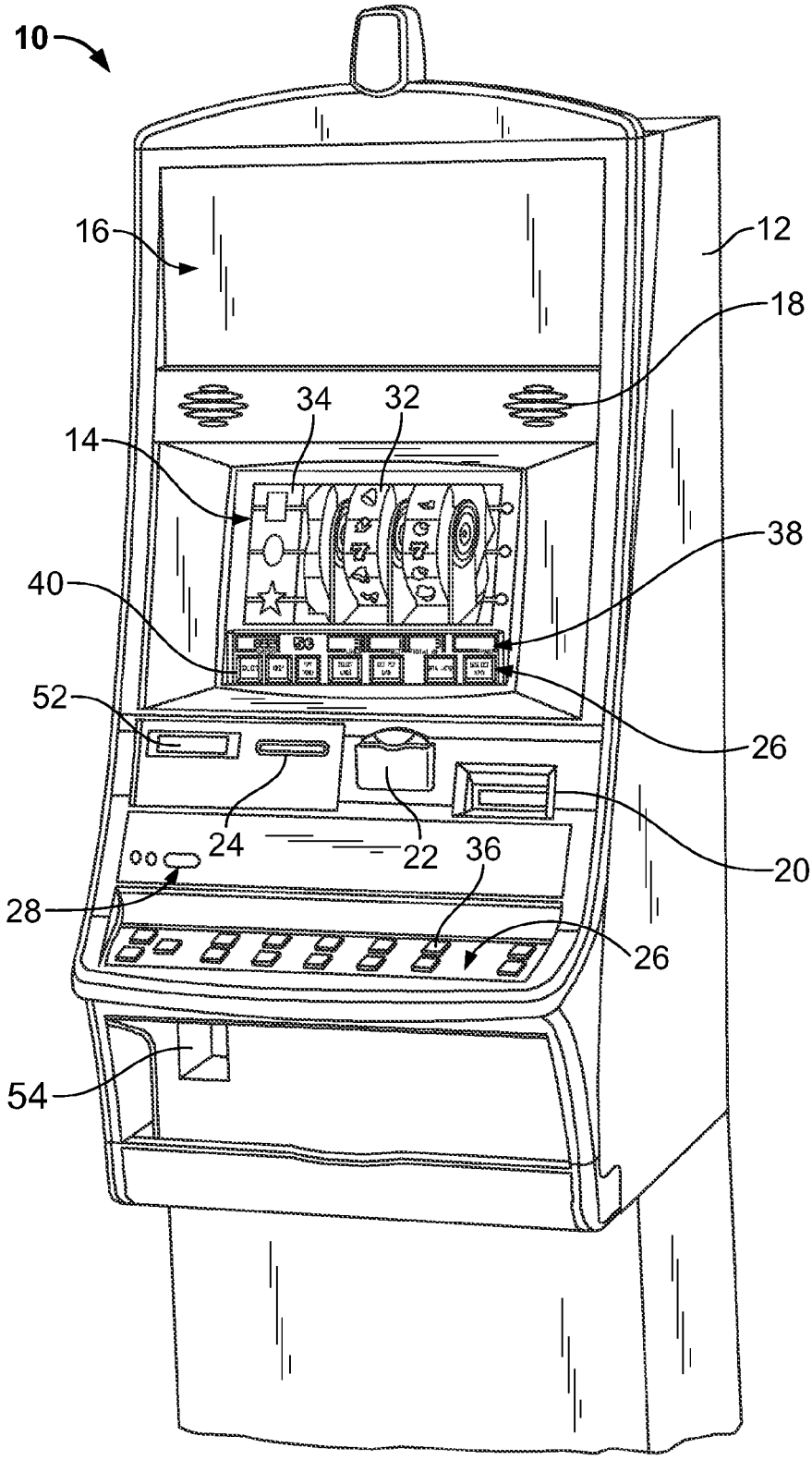
FIG. 1 (Prior Art)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is be an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 26, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 include, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354 entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
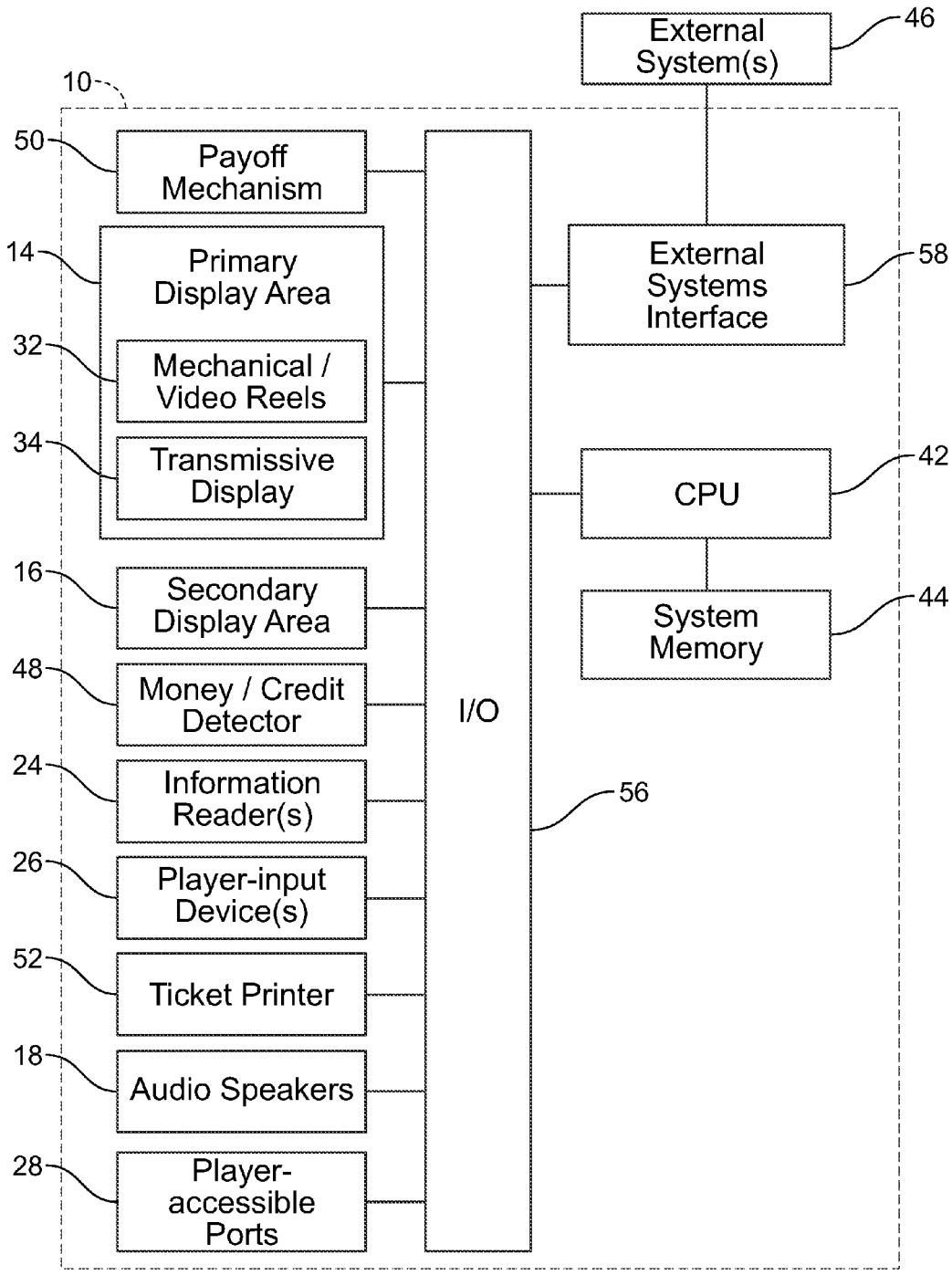
FIG. 2 (Prior Art)
FIG. 2 is a schematic view of a gaming system according to an embodiment of the present invention.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device(s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
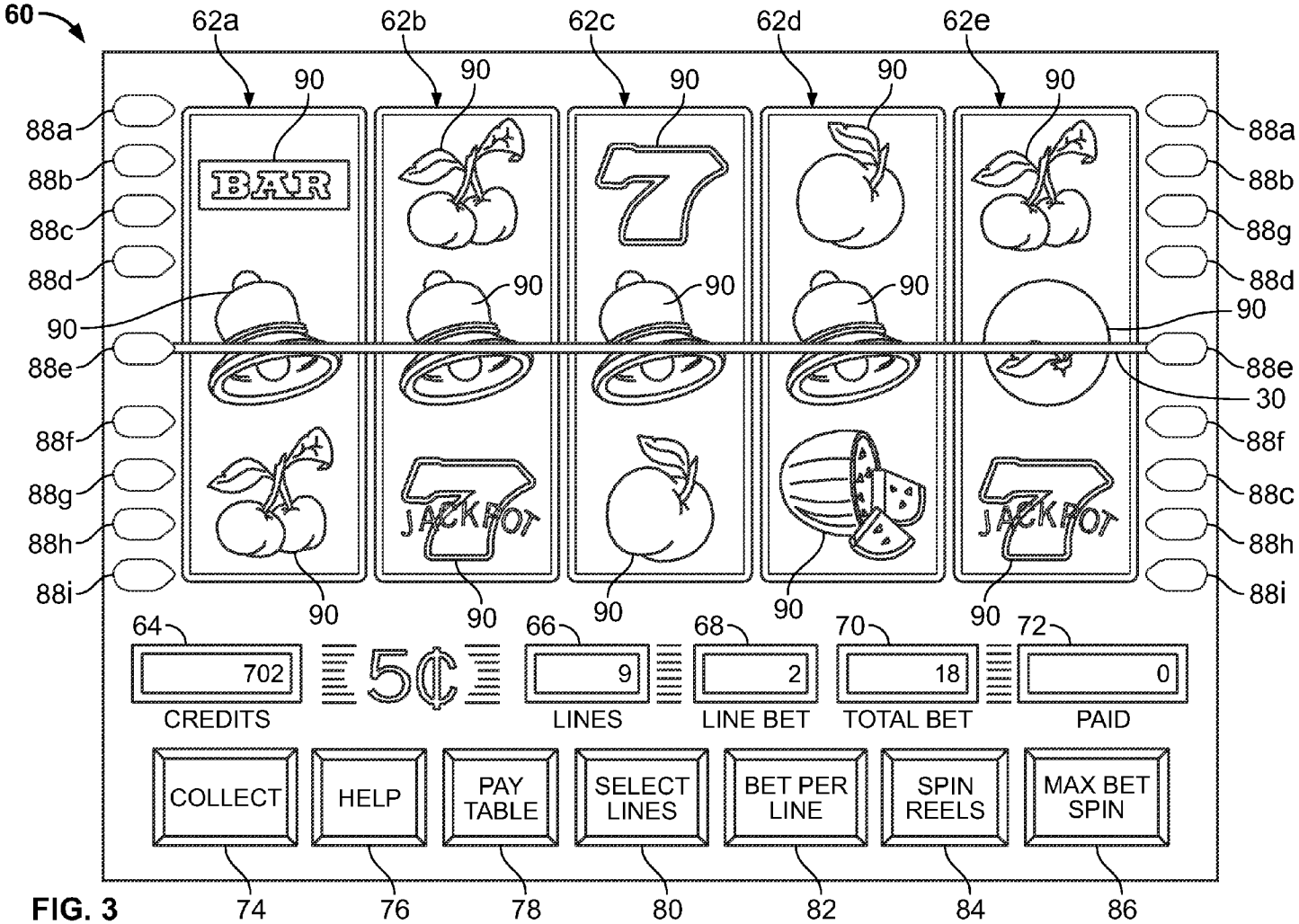
FIG. 3 (Prior Art)
FIG. 3 is an image of an exemplary basic-game screen of a wagering game displayed on a gaming terminal, according to an embodiment of the present invention.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present concepts, the wagering game includes a game sequence in which a player makes a wager, such as through the money/credit detector 48, touch screen 38 soft key, button panel, or the like, and a wagering game outcome is associated with the wager. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown in FIG. 3, different embodiments of the gaming terminal 10 comprise a greater or lesser number of reels in accordance with the present invention.

Figure 4:
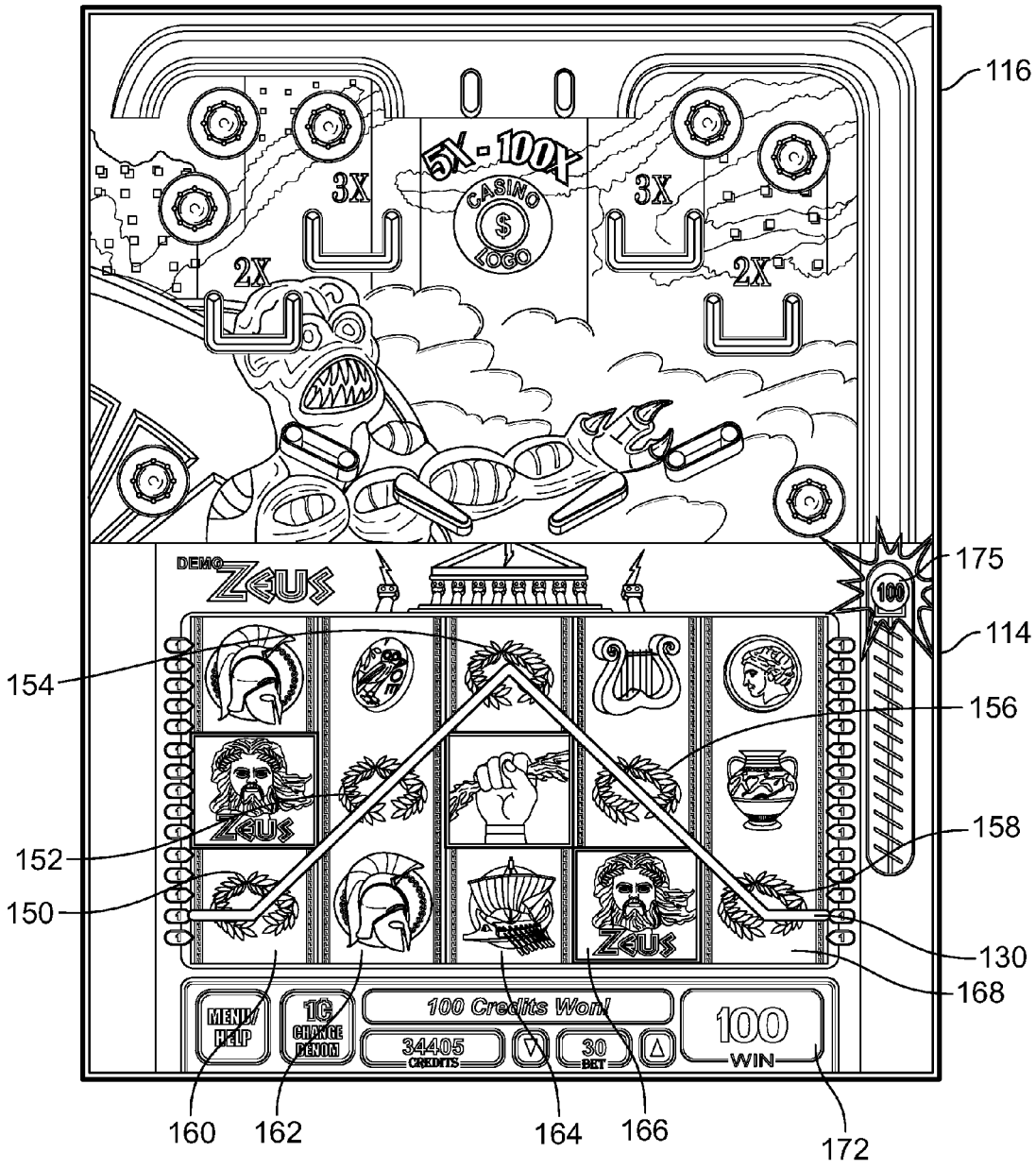
FIG. 4 is a view of a primary and secondary display area illustrating an implementation of an accumulation-bonus feature.

Referring now to FIG. 4, a basic wagering game and a bonus game are shown in primary display area 114 and secondary display area 114, respectively. In a typical wagering game, the bonus game is entered upon the occurrence of a triggering event, such as the occurrence of a start-bonus game outcome (e.g., symbol trigger, mystery trigger, time-based trigger, etc.) in or during the basic wagering game. An accumulation-bonus feature is provided that allows the player to select to play the bonus game at any time after a player has earned an award in the basic wagering game and the award has been cached to a bonus object, as described in more detail below. A particular example of this feature, as shown in FIG. 4, is a "Mega Multiplier" feature. In this particular aspect, a player is provided with an option to multiply any winning outcome in the basic wagering game via the accumulation-bonus feature, as described in more detail in the following paragraphs. It is also contemplated that any bonus game described herein can be deployed as a stand-alone wagering game independent of a basic wagering game.

As shown in FIG. 4, the primary display area 114 displays a randomly-determined winning outcome along a payline 130. The primary display area 114 can be displayed on a video display or can correspond to the primary display 14, for example. The winning payline 130 includes symbols 150, 152, 154, 156 and 158 along reels 160, 162, 164, 166 and 168, respectively. The player is awarded an award having a value of 100 credits in a "WIN" meter 172. According to an aspect, after reels 160, 162, 164, 166, 168 have spun and come to a stop and the player is awarded the credits in the "WIN" meter 172, the controller 42 randomly determines whether to cache the value of the credit award to a bonus object 175. In some aspects, regardless of whether the credit award is or is not cached to the bonus object 175, the credit award is provided to the player (as credits in the "WIN" meter 172). In other aspects, the credit award can go to either the "WIN" meter 172 or to the bonus object 175 but not both. In an example, the term "cache" can refer to storing the value associated with a winning outcome in a memory, such as the system memory 44 or in a memory of the external system(s) 46 (shown in FIG. 2) or other computer-readable memory device. The term cache is used to indicate that the bonus object 175 represents an object for accumulating values, which are "cached" or stored for later use. Each time a new value associated with a new winning outcome is achieved by the player of the basic wagering game, the new value is added to the previous value stored in the memory 44, 46. In some aspects, the adding can be a mathematical operation when the value represents a number. In others, the adding can be storing an indication of each of the values of associated winning outcomes in the memory 44, 46 and associating all values together with the bonus object 175. The "value" can represent anything of value, such as a number of credits, an opportunity to take some action in the basic wagering or bonus games, a free night's stay at the casino hotel, a free spin (in the event that the basic wagering game is a game of slots), a multiplier, and the like. The bonus object 175 shown in FIG. 4 is represented as a graphic that displays the cached value of the bonus object 175. The term "object" as used herein can refer to a software or virtual object displayed on a video display. The appearance of the bonus object 175 can change each time a new value is cached to the bonus object 175 responsive to a winning outcome being achieved in the basic wagering game.

In alternative aspects, a predetermined condition defined by the randomly determined outcome of the basic wagering game automatically causes the value associated with the randomly determined outcome to be cached to the bonus object 175. The predetermined condition can include, for example: (i) that a value associated with the randomly determined outcome is within a range of threshold values (e.g., between 100 and 200 credits), (ii) a certain preselected symbol occurring in the randomly determined outcome (e.g., a special preselected "cache" symbol that causes the value to be cached to the bonus object 175), (iii) a combination of symbols occurring in the randomly determined outcome, (iv) a combination of symbols along a particular payline occurring in the randomly determined outcome. In some cases, one or more of these conditions can be satisfied to automatically trigger a value to be cached to the bonus object 175.

In the example shown in FIG. 4, a random determination has been made to cache 100 credits to the bonus object 175. In this example, the bonus object 175 is shown as a "Mega Multiplier Coin." While the bonus object 175 shown in the example in FIG. 4 is a "Mega Multiplier Coin," it is contemplated that the bonus object 175 can include any type of bonus object and is not limited to the particular form factor (i.e., a coin) shown in FIG. 4. In this example, the bonus object 175 includes a value of "100" to be used in the accumulation-bonus feature of the present disclosure. At this point, the player can continue to play the basic wagering game, in the hopes of accumulating more values to be cached to the bonus object 175, or launch the bonus object 175 into a secondary playfield in the secondary display area 116. The secondary playfield is an area that is distinct from the area in which the basic wagering game is displayed. In the example shown, the primary display area 114 and the secondary display area 116 are linked in that the bonus object 175 starts in the primary display area 114 and seamlessly transitions into the secondary display area 116 when it is "launched" into the secondary playfield. The bonus object 175 will continue to accumulate values (either by a random determination by the controller 42 or by a predetermined condition that occurs in the basic wagering game) until the player opts to to launch the bonus object 175 into the secondary display area 116.

Generally, as soon as a value is cached to the bonus object 175, it is available for use by the player who can exercise an option at any time thereafter to utilize the bonus object 175. Usage of the bonus object 175 refers to an action taken by the player that causes a randomly determined enhancement condition to be applied to at least one of the values cached to the bonus object 175, as explained further below. In the example of FIG. 4, usage of the bonus object 175 can be accomplished by pressing one of the buttons 36 on the button panel of the gaming terminal 10 or by touching (and optionally sliding or moving) a graphic displayed relative to the touch screen 38, 138.

Figure 5:
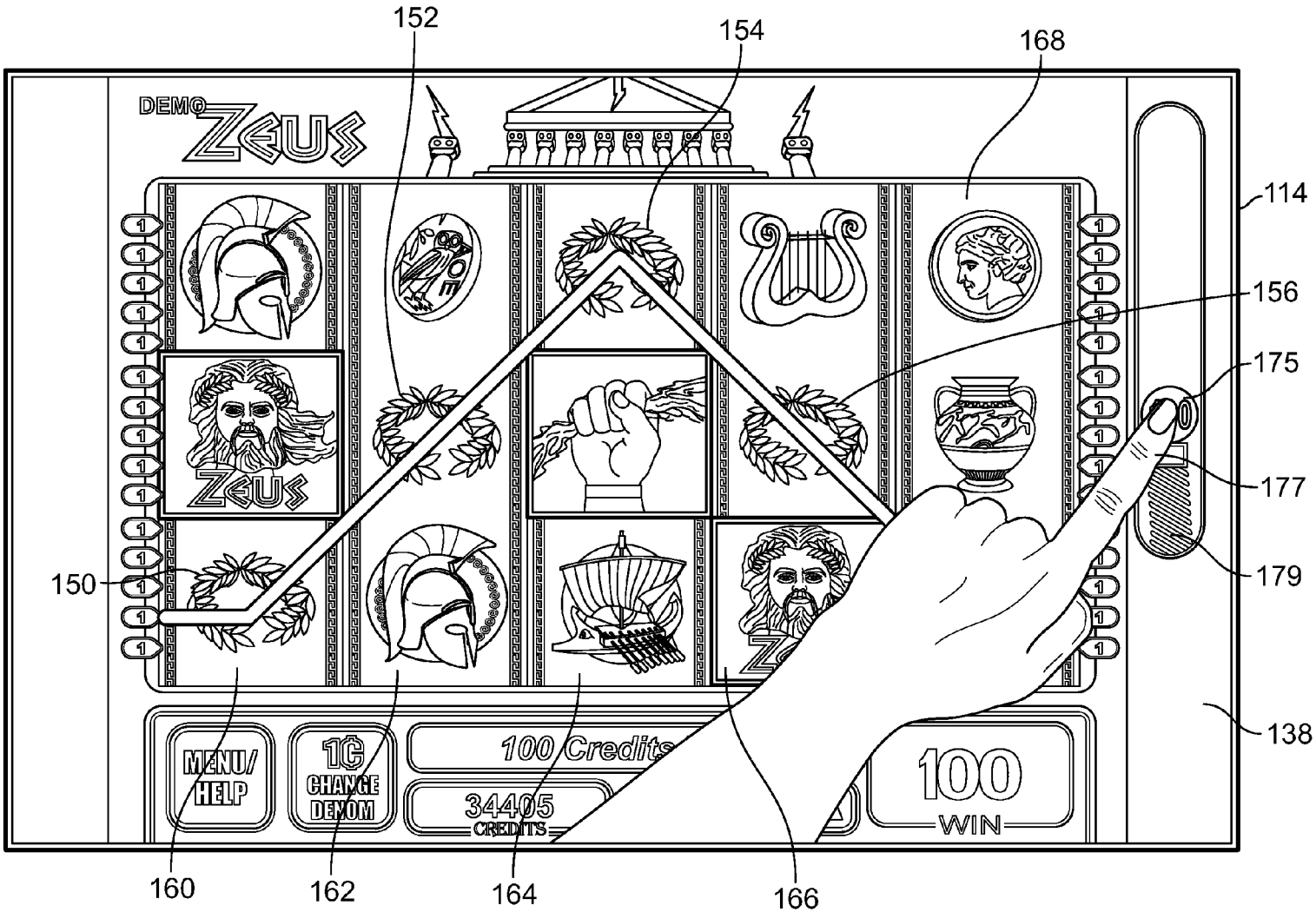
FIG. 5 is a view of a primary display area illustrating a player initiating play of an accumulation-bonus feature according to the present disclosure.

FIG. 5 depicts the player launching the bonus object 175 with a value of 100 credits. Specifically, FIG. 5 shows a player using his or her finger 177 to indicate a gesture in association with the touch screen 138. In this example, the player makes a gesture indicating the drawing back of the bonus object 175 via a spring-activated object 179 that is displayed adjacent to the bonus object 175 on the primary display area 114. It is envisioned that are many other ways of launching the bonus object 175 and can be used for moving the bonus object 175 from the primary display area 114 to the secondary display area 116. In some aspects, as described above, the player can opt to launch the bonus object 175 immediately after the spin in the basic wagering game is over. In yet other aspects, the player can opt to save up wins (i.e., cache the values) and launch the bonus object 175 at a later time. In both situations, the bonus object 175 accumulates the cached values and the player chooses when to launch the bonus object 175.

Once the player launches, or otherwise uses, the bonus object 175, the bonus object 175 is placed into a playfield or bonus environment, which may be displayed in the secondary display area 116. The secondary display area 116 may include any type of secondary bonus area in which the bonus object 175 moves around and "lands" on certain areas that are associated with an enhancement condition. For example, in FIG.

6, an enhancement condition occurs at areas 181, 183, 185, 187 and 189. These enhancement conditions can be associated with multipliers, e.g., 2×, 3×, etc., such that when the bonus object 175 lands on one of the enhancement condition areas 181, 183, 185, 187 and 189, the entirety of the values cached to the bonus object 175 is multiplied by the specific multiplier. The movement of the bonus object 175 around the secondary display area 116 can be depicted using special graphics showing the bonus object 175 bouncing around using real-time physics gravity effects. Certain elements 193, such as flippers or bumpers, can be shown being triggered automatically to always save the bonus object 175 while it is "in play." Which enhancement condition will be applied to the values cached to the bonus object is randomly determined.

Figure 6:
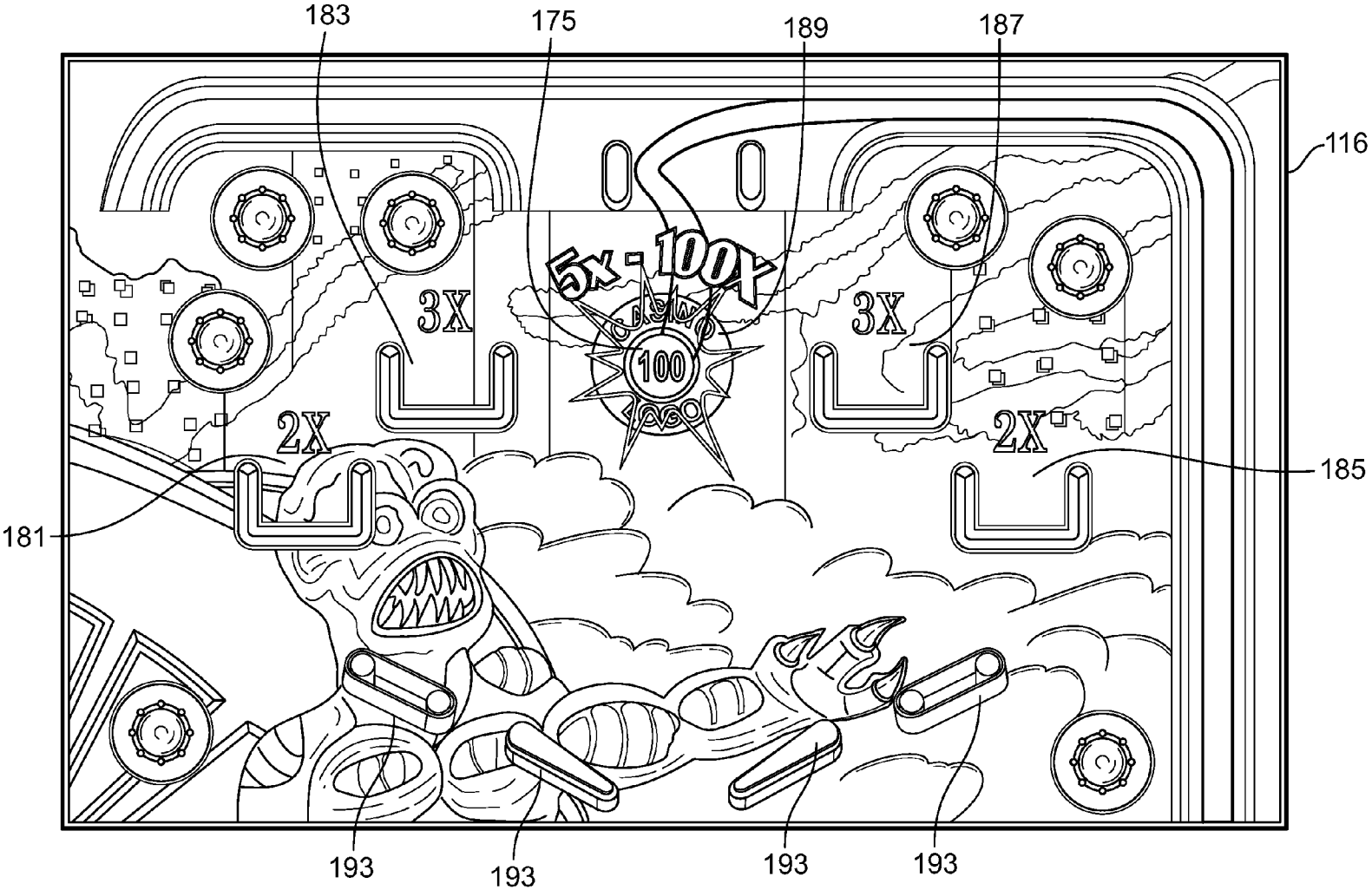
FIG. 6 is a view of a secondary display area illustrating play of an accumulation-bonus feature according to the present disclosure.

As depicted in FIG. 6, the bonus object 175 has been randomly determined to land in area 189, which is associated with a center area of the secondary display area 116. The center area 189 can be custom-themed to indicate a specific casino logo or other means of identifying a casino or gaming establishment. If the bonus object 175 lands in the center area 189, a special bonus can be awarded. In this example, the center area 189 is associated with a 5×-100× multiplier. In some aspects, in response to the bonus object 175 landing in the center area 189, the enhancement conditions associated with the areas 181, 183, 185, 187 and 189 are changed, e.g., increased. For example, as shown in FIG. 7, the multipliers in the areas 181 and 185 have been increased from 2× to 5×, and the multipliers in the areas 183 and 187 have been increased from 3× to 10×. The occurrence of the bonus object 175 landing in the center area 189 is termed a special event that causes the enhancement condition to change.

Figure 7B:
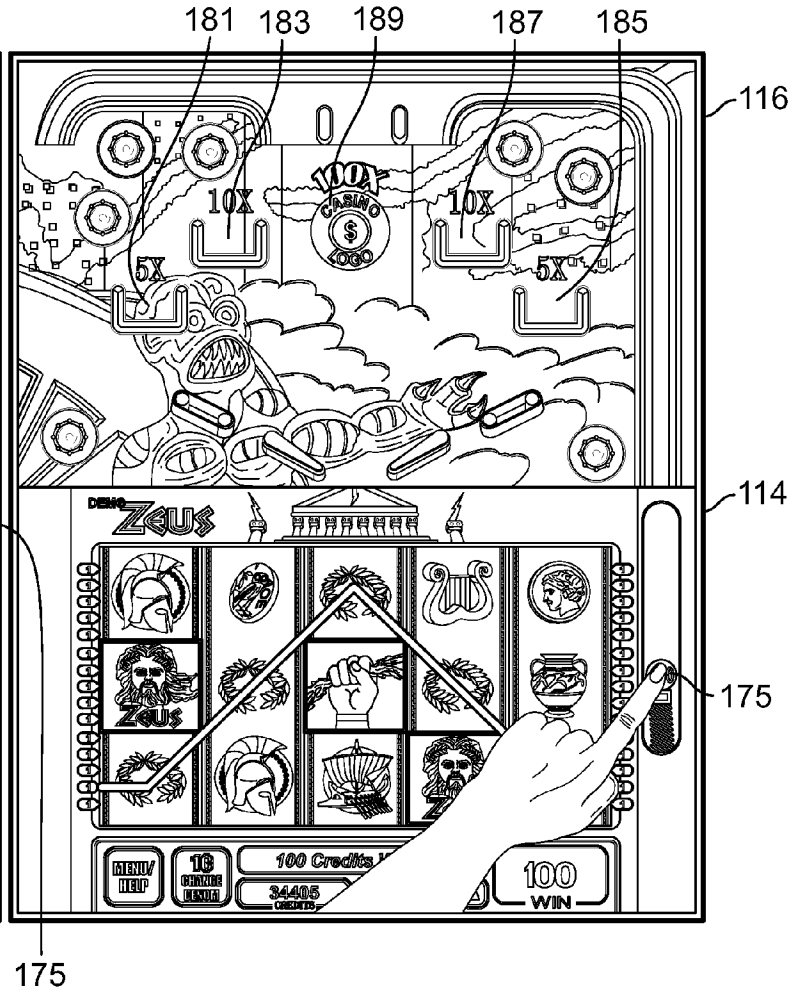
FIG. 7 is a view of a primary and secondary display area illustrating an enhanced state of an accumulation-bonus feature according to an implementation of the present disclosure.
Figure 7A:
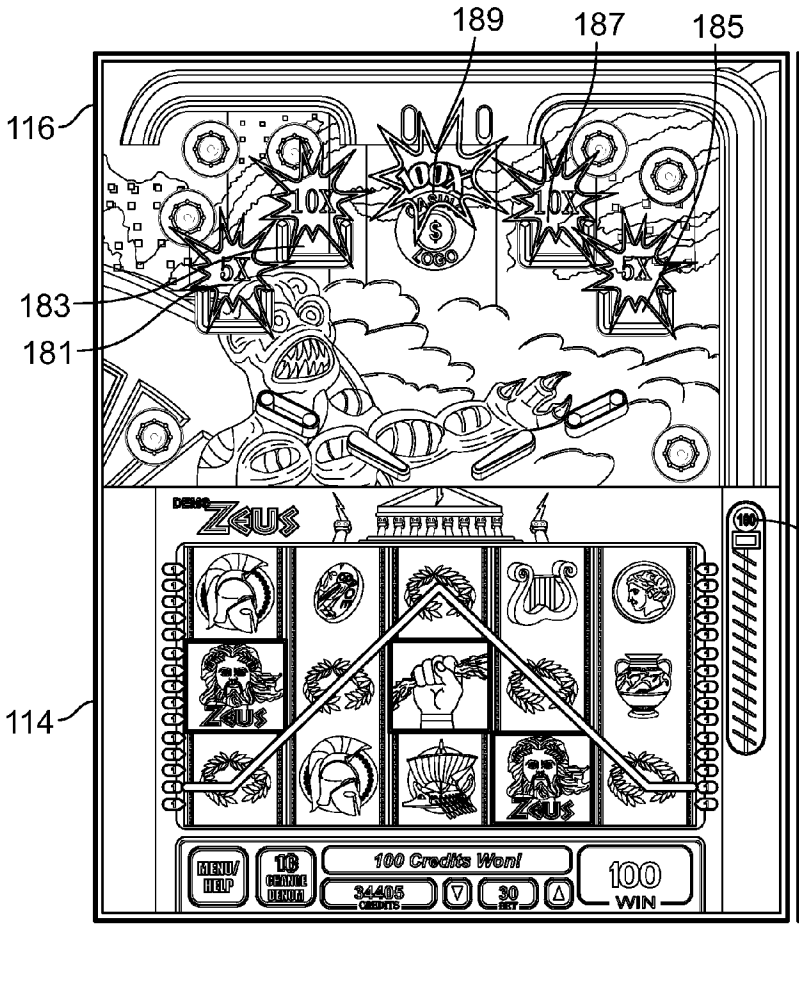
Figure 8:
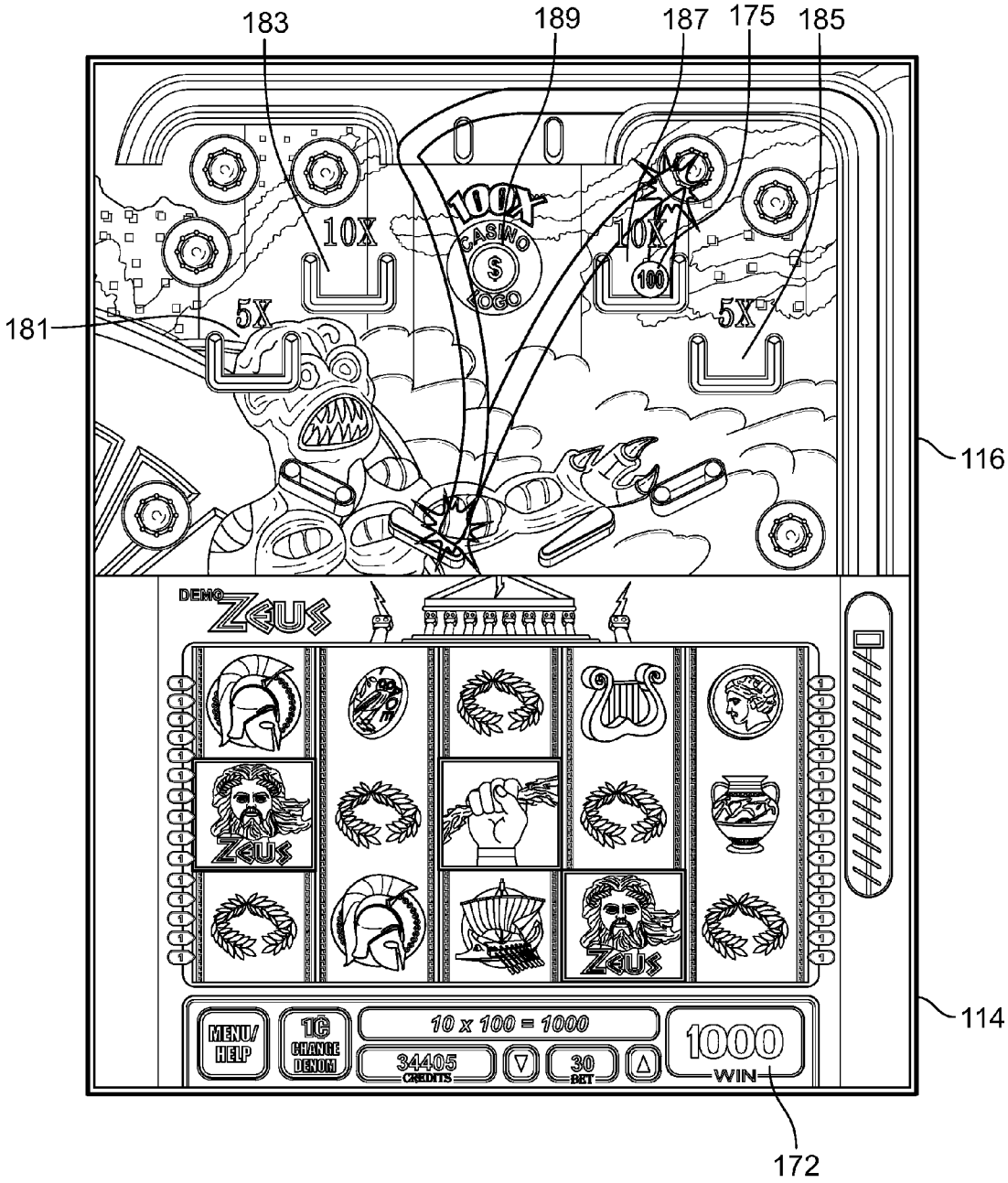
FIG. 8 is a perspective view of a primary and secondary display area illustrating a final state of an accumulation-bonus feature according to the present disclosure.

After the enhancement conditions are increased, the player is allowed to relaunch the bonus object 175 into the secondary display area 116, as shown in FIGS. 7*a* and 7*b*. In some aspects, the center area 189, containing the casino identification or logo, can be associated with a large award, e.g., a jackpot award, and/or a large multiplier. Upon relaunching, the bonus object 175 is depicted as bouncing around the secondary display area 116 and coming to a stop in one of the areas 181, 183, 185, 187 or in the center area 189, as shown in FIG. 8. The area that the bonus object 175 lands in is randomly determined by a controller, such as the controller 42. The cached value of the bonus object 175 is multiplied by the enhancement condition. In the embodiment shown in FIG. 8, the bonus object 175 lands in the area 185 and the enhancement condition is a 10× multiplier. Thus, the cached value of 100 is multiplied by 10 to increase the award to 1000 credits, as shown in "WIN" meter 172. In further aspects, if more than a single value is cached to the bonus object 175, the player receives the entire amount of the values cached to the bonus object 175 and multiplied by the multiplier associated with the randomly determined enhancement condition.

In some aspects, the player can have an option to "cash out" the equity of the values cached to the bonus object 175 and receive an average enhancement condition that is applied to the cached values rather than launching the bonus object 175 into the secondary display area 116 and receiving an enhancement condition that is greater than or less than the average enhancement condition.

In some casinos or gaming establishments, it may be necessary to limit the value of the total award to a maximum limit as a result of the accumulation-bonus feature. For example, a multiplier value may be capped if a certain value, i.e., 500×, of the total value cached to the bonus object 175. In some cases, an average multiplier value is awarded to limit the maximum jackpot exposure to the casino. In yet other situations, a casino can cap the total amount that a player can win, i.e., by capping the win amount at 2500 times the maximum possible bet of the game or a preconfigured max jackpot value (i.e. $10,000), as a way of limiting the casino's maximum jackpot exposure. In this case, it may be necessary to implement a mystery award of, for example, 2500× the total bet. The odds of this award occurring would vary depending on the base game that the accumulation-bonus feature is paired with. A mystery award is needed to compensate for the capping feature, which causes a slight EV loss, i.e., 1%, depending on the paired base game. This cap also guarantees that the top award is within the maximum odds.

Figure 9:
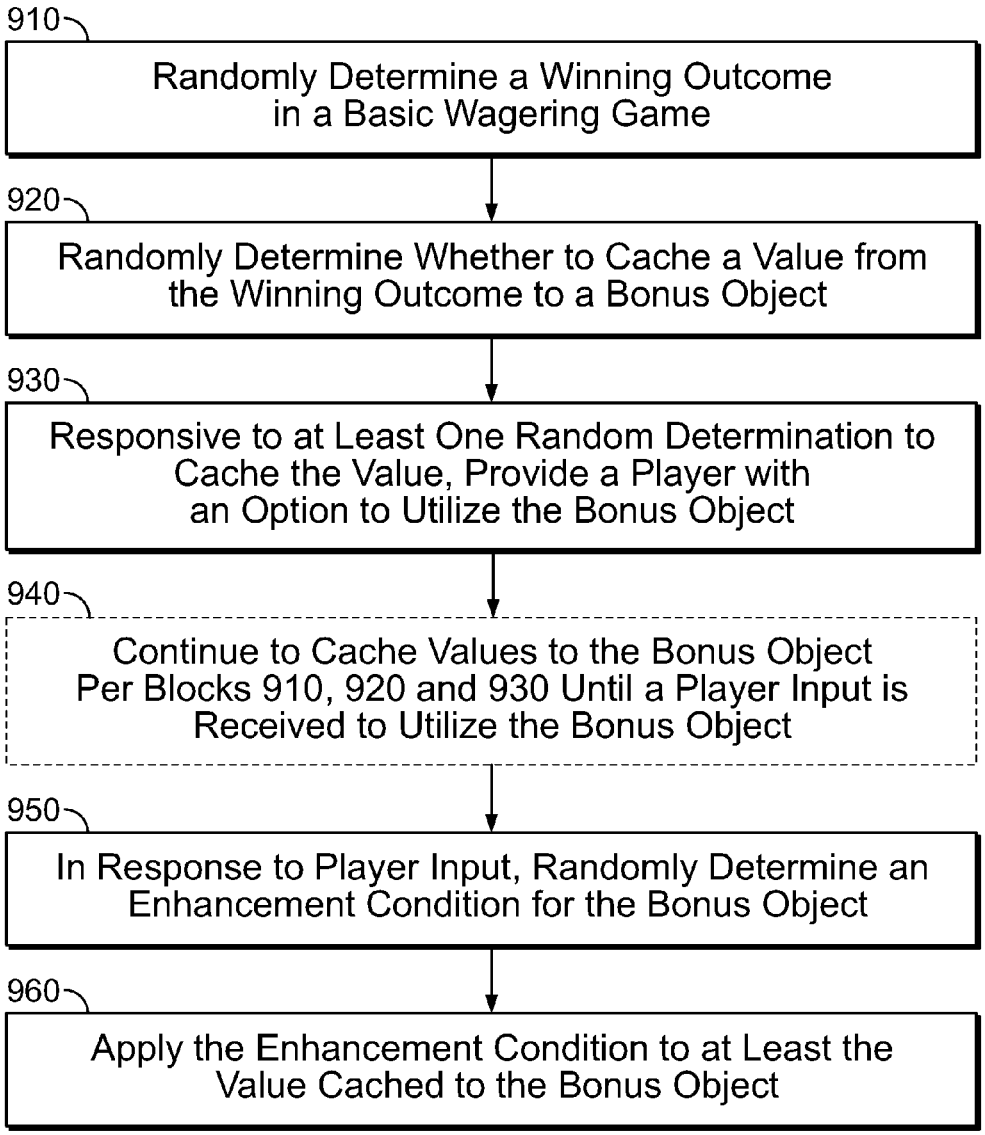
FIG. 9 is a flowchart for an algorithm that corresponds to instructions executed by a controller in accord with at least some aspects of the present disclosure.

FIG. 9, described by way of example above, represents an algorithm that corresponds to at least some instructions executed by the controller 42 and/or external systems 46 in FIG. 2 to perform the above described functions associated with the disclosed concepts. For example, a winning outcome is randomly determined in a basic wagering game (910). The controller (42) randomly determines whether to cache a value from the winning outcome to a bonus object (920). After at least one random determination to cache the value, a player can opt to utilize the bonus object (930). The controller (42) continues to cache values to the bonus object per blocks 910, 920 and 930 until a player input is received to utilize the bonus object (940). In response to player input, the controller (42, 46) randomly determines an enhancement condition for the bonus object (950). The controller (42, 46) applies the enhancement condition to the entirety of the values cached to the bonus object (960).

Each of these embodiments and obvious variations thereof is contemplated as falling within the spirit and scope of the claimed invention, which is set forth in the following claims.

What is claimed is:

1. A gaming system comprising:

a user interface device to accept a wager input to play a wagering game;

a display adapted for displaying a randomly determined outcome of the wagering game from a plurality of outcomes; and a controller operative to randomly determine a winning outcome from the plurality of outcomes, the winning outcome associated with a value;

display and accumulate to a credit meter at least some of the plurality of outcomes that are winning outcomes;

independently from the randomly determined outcome, randomly determine whether to cache the value to a bonus object that is distinct from the credit meter;

display on the display the bonus object as a graphical object distinct from the credit meter, the bonus object being utilizable by the player using a player-input device;

responsive to at least one random determination to cache the value, provide a player an option to utilize the bonus object by making the bonus object available for utilization on the display via the player-input device;

in response to the utilization of the bonus object, randomly determine an enhancement condition for the bonus object; and apply the enhancement condition to at least the value cached to the bonus object.

2. The gaming system of claim 1, wherein the controller is further operative to continue to randomly determine whether to cache additional values associated with corresponding randomly determined winning outcomes to the bonus object until the bonus object is utilized, wherein the enhancement condition is applied to the entirety of the values cached to the bonus object.

3. The gaming system of claim 1, wherein the bonus object represents an object for accumulating the cached values.

4. The gaming system of claim 1, wherein the controller is further operative to cause the bonus object to be launched into a secondary playfield which indicates a plurality of enhancement conditions that include the enhancement condition.

5. The gaming system of claim 1, wherein the enhancement condition is a multiplier, and wherein the controller applies the enhancement condition by multiplying at least the value cached to the bonus object by the multiplier.

6. The gaming system of claim 1, wherein the controller is further operative to change the enhancement condition based on a special event.

7. The gaming system of claim 1, wherein the controller is further operative to determine whether a second randomly determined winning outcome satisfies a predetermined condition that automatically causes a second value associated with the second winning outcome to be cached to the bonus object.

8. The gaming system of claim 7, wherein the predetermined condition includes the second value falling within a predetermined range of values or at least one symbol representing the second winning outcome satisfying a predetermined criterion.

9. The gaming system of claim 8, wherein the predetermined criterion includes whether the at least one symbol is a predetermined symbol preselected to cause the value to be cached to the bonus object.

10. The gaming system of claim 8, wherein the predetermined criterion includes whether the second winning outcome is represented by a predetermined combination of symbols including the at least one symbol, which is preselected to cause the value to be cached to the bonus object.

11. The gaming system of claim 8, wherein the predetermined criterion includes whether a predetermined combination of symbols including the at least one symbol appear across a predetermined payline that is preselected to cause the value to be cached to the bonus object.

12. A gaming device comprising:

a wager input device for receiving a wager to play a wagering game;

one or more processors for randomly determining an outcome of the wagering game from a plurality of outcomes, at least one of the outcomes being a winning outcome associated with a value, any of the one or more processors randomly determining, independently of the randomly determining the outcome of the wagering game, whether to cache the value to a bonus object that is distinct from a credit meter that accumulates at least some of the plurality of outcomes that are winning outcomes;

a display that displays the bonus object as a graphical object distinct from the credit meter;

a player input device for utilizing the bonus object; and wherein any of the one or more processors continue to randomly determine whether to cache values to the bonus object until a player input is received from the player input device to utilize the bonus object displayed on the display, the player input causing any of the one or more processors to randomly determine an enhancement condition for the bonus object, the enhancement condition being applied to the entirety of the values cached to the bonus object.

13. The gaming device of claim 12, wherein the one or more processors cause the bonus object to be launched into a secondary playfield which indicates a plurality of enhancement conditions that include the enhancement condition.

14. The gaming device of claim 12, wherein the enhancement condition is a multiplier, and wherein the one or more processors applies the enhancement condition by multiplying at least the values cached to the bonus object by the multiplier.

15. The gaming device of claim 12, wherein the one or more processors is further operative to change the enhancement condition based on a special event.

16. A method of conducting a wagering game for a human player, the wagering game including a game sequence in which the player provides a wager input and a wagering game outcome is determined, the method comprising the acts of:

using a user interface device to accept the wager input, and transforming the wager input to electronic data signals indicative of a wager to play the wagering game;

using one or more processors to interpret the wager from the data signals and to cause the recording of a digital representation of the wager in one or more storage devices;

using at least one of the one or more processors to initiate the game sequence of the wagering game and to randomly determine the wagering game outcome;

in response to the randomly determined outcome being a winning outcome associated with a value, using at least one of the one or more processors to randomly determine whether to cache the value to a bonus object independently from the random determination of the wagering game outcome;

display on a display device, displaying the bonus object as a graphical object;

responsive to at least one random determination to cache the value, providing the player an option to utilize the bonus object by making the bonus object available for utilization on the display;

continuing to use at least one of the one or more processors to randomly determine wagering game outcomes associated with corresponding values and to randomly determine whether to cache the corresponding values associated with the randomly determined winning game outcomes to the bonus object until a player input is received to utilize the bonus object;

accumulating to a credit meter that is distinct from the bonus object at least some of the wagering game outcomes;

in response to the player input and after a plurality of cached values have been accumulated to the bonus object, using at least one of the one or more processors to randomly determine an enhancement condition for the bonus object; and applying the enhancement condition to all of the values cached to the bonus object.

17. The method of claim 16, further comprising causing the bonus object to be launched into a secondary playfield which indicates a plurality of enhancement conditions that includes the enhancement condition.

18. The method of claim 16, wherein the enhancement condition is a multiplier for multiplying the cached values, wherein the applying the enhancement condition includes multiplying the values cached to the bonus object by the multiplier.

19. The method of claim 16, further comprising changing the enhancement condition to a second enhancement condition based on a special event and applying the second enhancement condition to at least one of the values cached to the bonus object.

20. A method of conducting a wagering game on a gaming system, the method comprising:

using one or more processors to randomly determine an outcome of the wagering game, the randomly determined outcome being associated with a value;

in response to the randomly determined outcome satisfying a predetermined condition, any of the one or more processors causing the value of the randomly determined outcome to be cached to a bonus object;

displaying on a display device the bonus object as a graphical object;

providing the player with an option to utilize the bonus object by making the bonus object available for utilization on the display device;

continuing to use any of the one or more processors to randomly determine outcomes associated with corresponding values and to cache the corresponding values in response to the randomly determined outcomes satisfying the predetermined condition until a player input is received to utilize the bonus object;

accumulating to a credit meter that is distinct from the bonus object at least some of the randomly determined outcomes;

in response to the player input, using any of the one or more processors to randomly determine an enhancement condition for the bonus object after accumulation of a plurality of cached values to the bonus object, the enhancement condition being applied to the entirety of the values cached to the bonus object and selected from among a plurality of enhancement conditions.

21. The method of claim 20, wherein the predetermined condition includes the value of the randomly determined outcome being within a range of threshold values.

22. The method of claim 20, wherein the predetermined condition includes a predetermined symbol occurring in the randomly determined outcome.

23. The method of claim 20, wherein the predetermined condition includes a combination of symbols occurring in the randomly determined outcome.

24. The method of claim 20, wherein the predetermined condition includes a combination of symbols along a particular payline occurring in the randomly determined outcome.

25. A computer program product comprising a computer readable medium having an instruction set borne thereby, the instruction set being configured to cause, upon execution by a controller, the acts of:

using a user interface device to accept a wager input, and transforming the wager input to electronic data signals indicative of a wager to play a wagering game;

using one or more processors to interpret the wager from the data signals and to cause the recording of a digital representation of the wager in one or more storage devices;

using at least one of the one or more processors to initiate a game sequence of the wagering game and to randomly determine a wagering game outcome;

in response to the randomly determined outcome being a winning outcome associated with a value, using at least one of the one or more processors to randomly determine whether to cache the value to a bonus object;

display on a display device the bonus object as a graphical object;

responsive to at least one random determination to cache the value, providing the player an option to utilize the bonus object by making the bonus object available for utilization on the display device;

continuing to use at least one of the one or more processors to randomly determine wagering game outcomes associated with corresponding values and to randomly determine whether to cache the corresponding values associated with the randomly determined winning game outcomes to the bonus object until a player input is received to utilize the bonus object;

accumulating to a credit meter that is distinct from the bonus object at least some of the wagering game outcomes;

in response to the player input, using at least one of the one or more processors to randomly determine an enhancement condition for the bonus object after accumulation of a plurality of cached values to the bonus object; and applying the enhancement condition to all of the values cached to the bonus object.

* * * * *